United States Patent [19]

Espiritu

[11] Patent Number: 4,547,035

[45] Date of Patent: Oct. 15, 1985

[54] ELECTRICAL CONNECTOR ENDBELL

[75] Inventor: Hermenegildo A. Espiritu, Cerritos, Calif.

[73] Assignee: International Telephone & Telegraph Corp., New York, N.Y.

[21] Appl. No.: 457,849

[22] Filed: Jan. 14, 1983

[51] Int. Cl.[4] ..... H01R 13/58

[52] U.S. Cl. ..... 339/103 M; 339/206 R; 339/210 M

[58] Field of Search ..... 339/103, 105, 107, 101

[56] References Cited

U.S. PATENT DOCUMENTS

| | | | |
|---|---|---|---|
| 2,420,826 | 5/1947 | Irrgang | 174/153 |
| 2,424,759 | 7/1947 | Klumpp, Jr. | 174/153 |
| 2,450,271 | 9/1978 | Dann | 339/103 M |
| 2,913,791 | 11/1959 | Martin | 24/126 |
| 2,968,851 | 1/1961 | Hardy | 24/135 |
| 2,974,186 | 3/1961 | Klumpp, Jr. | 174/153 |
| 3,014,194 | 12/1961 | Berglund | 339/75 |
| 3,076,655 | 2/1963 | Washburn, Jr. | 277/4 |
| 3,141,062 | 7/1964 | Rapata | 174/153 |
| 3,249,687 | 3/1966 | Klumpp, Jr. | 174/153 |
| 3,424,856 | 1/1969 | Coldren | 174/153 |
| 3,751,579 | 8/1973 | Nojiri | 174/153 |
| 3,755,615 | 8/1973 | Paullus et al. | 174/76 |
| 3,787,798 | 1/1974 | Carissimi et al. | 339/107 |
| 4,002,821 | 1/1977 | Satoh et al. | 174/153 |
| 4,002,822 | 1/1977 | Kurosaki | 174/153 |
| 4,005,922 | 2/1977 | Burkhart et al. | 339/107 |
| 4,077,085 | 3/1978 | Yuda | 16/2 |
| 4,142,064 | 2/1979 | Thomsen | 174/153 |
| 4,143,934 | 3/1979 | Siebert | 339/75 |
| 4,284,317 | 8/1981 | Doyle | 339/103 R |
| 4,354,723 | 10/1982 | Lee | 339/103 R |

FOREIGN PATENT DOCUMENTS

| | | | |
|---|---|---|---|
| 713104 | 8/1954 | United Kingdom | 38/1 |
| 1503259 | 3/1978 | United Kingdom . | |

OTHER PUBLICATIONS

"Approaches to EMI Control in Digital Data Transmission Systems," by John Landis-AMP Incorporated, *Fifteenth Annual Connectors and Interconnection Technology Symposium Proceedings,* published by Electronic Connector Study Group, Inc.

*Primary Examiner*—Gil Weidenfeld
*Assistant Examiner*—David L. Pirlot
*Attorney, Agent, or Firm*—T. L. Peterson; R. C. Turner

[57] ABSTRACT

An electrical connector endbell in which the endbell housing is slotted so that the cable of the connector may be pushed laterally into the interior of the housing through the slot after the cable has been connected to the contacts in the connector shell. A cover is slidably removable on the endbell housing to close the slot. Screw threads are formed in the interior of the cover and the forward end of the housing for threading the endbell onto the rear of the connector shell.

13 Claims, 3 Drawing Figures

ELECTRICAL CONNECTOR ENDBELL

BACKGROUND OF THE INVENTION

The present invention relates generally to electrical connectors, and more particularly, to an endbell for electrical connectors.

It is common to utilize an endbell on an electrical connector to protect the wires of the electrical cable which are connected to the contacts in the connector shell and to prevent dust, particles and moisture from entering the rear of the connector. The endbell provides strain relief for the cable so that excessive forces applied to the cable will not cause the wires thereof from being disconnected from the contacts in the connector shell.

It is the normal practice to initially slide the endbell over the cable and then connect the wires of the cable to the connector contacts, which are typically installed in the insert or insulator in the connector shell after the contacts are terminated to the wires. After all the contacts are installed in the insulator, the endbell is pushed forwardly on the cable so that it may be threaded to the rear of the connector shell. It will be appreciated that if the installer fails to initially place the endbell over the electrical cable, there is no way to mount the endbell on the rear of the connector shell without first removing all of the contacts from the connector since the connector shell is so large that the endbell may not be assembled over the shell from the front.

It is an object of the present invention to provide a novel endbell which may be installed on an electrical connector harness assembly even after the wires of the cable have been connected to the contacts of the connector and the contacts have been installed in the connector insulator.

SUMMARY OF THE INVENTION

According to a principal aspect of the present invention, there is provided an endbell in which a longitudinally extending slot is formed in the wall of the endbell housing which is dimensioned to allow the cable of a harness assembly to be pushed laterally through the slot into the interior of the housing. After the endbell housing is installed over the cable, a cover is installed on the housing to close the slot. The forward end of the housing and the cover are threaded so that the assembly may be threadedly engaged as a unit with the shell of the connector. By removing the cover from the housing, the endbell housing may be conveniently removed from the cable thereby facilitating any servicing or modification of the connector, such as the adding of additional contacts to the connector insert or replacing damaged contacts.

DESCRIPTION OF THE PREFERRED EMBODIMENT

Figures 1, 2, 3:
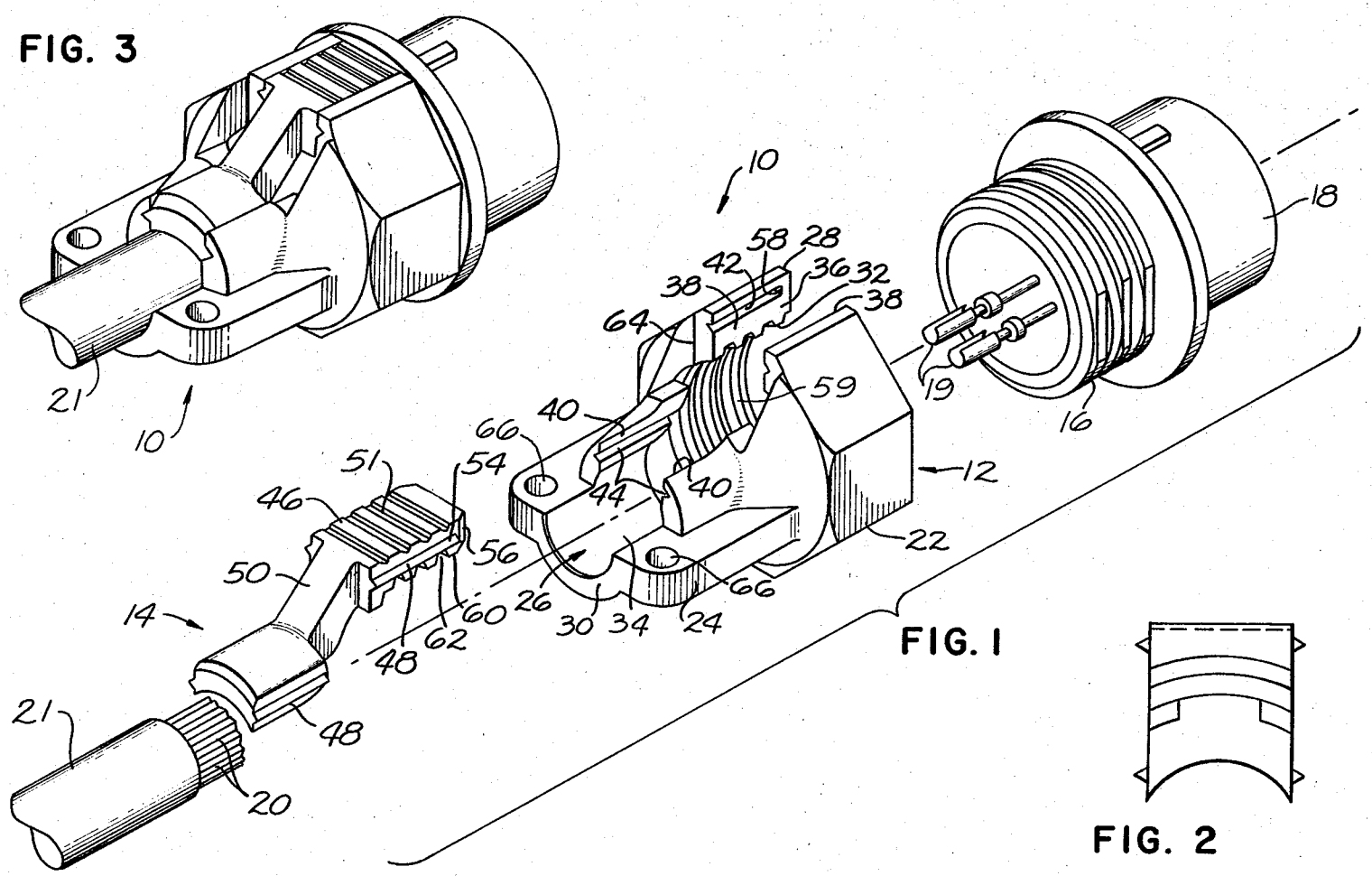
FIG. 1 is an exploded, perspective view of the endbell of the present invention, with the cover thereof removed from the endbell housing, and also showing the connector to which the endbell is to be assembled and the cable.
FIG. 2 is a front end view of the cover illustrated in FIG. 1.
FIG. 3 is a perspective view showing the assembled endbell threaded onto the rear of the connector shell, with the cable extending from the rear of the endbell housing.

While the present invention will be described specifically in connection with an endbell for an electrical connector, it will be appreciated that the endbell could be utilized for other connectors, such as fiber optic connectors, in which case the cable contains optical fibers rather than metal wires.

The endbell of the present invention, generally designated 10, comprises a housing 12 and a removable cover 14. As shown in FIG. 3, the endbell is threaded onto the rear 16 of an electrical connector shell 18. The shell contains a plurality of contacts 19 mounted in an insert, not shown, the contacts being connected to wires 20 extending through a cable 21 which extends outwardly through the rear of the endbell 10 in the customary manner.

The endbell housing 12 and cover 14 may conveniently be formed from molded plastic. The housing comprises an enlarged forward portion 22 having flat surfaces on its outer perimeter, much like a conventional nut, for facilitating threading of the endbell onto the threaded rear portion 16 of the shell 18. The housing also includes a somewhat flat rear portion 24. A central bore 26 extends from the front 28 of the housing to the rear 30 thereof. The bore includes a forward large diameter section 32 which opens at the front 28 of the housing, and a relatively small diameter rear section 34 which opens at the rear 30 of the housing. The rear section 34 of the bore is dimensioned to receive the cable 21 therein with a relatively close fit.

A longitudinally extending slot 36 is formed in the wall of the endbell housing 12. The width of the slot is selected such that the cable 21 may be slidably pushed laterally through the slot into the bore 26 in the housing. The slot forms a first pair of parallel longitudinally extending side walls 38 in the forward portion 22 of the housing and a second pair of similar side walls 40 in the rear portion 24 of the housing. A pair of longitudinally extending parallel grooves 42 are formed in the side walls 38. A second pair of longitudinally extending parallel grooves 44 are formed in the side walls 40.

The cover 14 embodies a forward portion 46 having longitudinally extending tongues 48 on its opposite sides which are dimensioned to slide in the grooves 42. The rear portion 48 of the cover, which is offset from the forward portion 46 by an angular intermediate section 50, is likewise provided with longitudinally extending tongues 52 on its opposite sides dimensioned to slide in the grooves 44 of the housing. Thus, by this arrangement the cover 14 may be assembled to the housing 12 by simply aligning the respective sets of tongues 48 and 52 with the matching grooves 42 and 44 in the housing and sliding the cover forwardly. Transverse grooves 51 are formed in the outer surface of the forward portion 46 of the cover to facilitate pushing of the cover onto the housing, and removal of the cover from the housing.

The forward ends of 54 of the tongues 48 on the cover terminate behind the front 54 of the cover providing stop shoulders which engage the inner ends 58 of the grooves 42 in the housing when the cover 14 is fully slid into its assembled position in the housing.

The wall of the large diameter section 32 of the bore 26 in the housing is threaded as indicated at 59 so that the housing may be threaded onto the threaded rear portion 16 of the connector shell. The inner surface of the forward portion 46 of the cover is formed with thread ridges 60 and grooves 62 which form continuations of the thread ridges and grooves in the housing 12 so that the cover and housing may be threaded as a unit on to the connector shell. It will be appreciated that when the assembled endbell is threaded onto the connector shell, the matching threads on the two parts will prevent the cover 14 from being disassembled from the endbell housing.

The stop shoulders 54 on the cover 14 and the bottoms of the grooves 58 in the endbell housing are precisely located to assure that the thread ridges and grooves on the cover will match properly with the thread ridges and grooves in the interior of the endbell housing.

To use the endbell of the present invention it will be appreciated that initially the conductors of the cable 21 may be connected to the contacts 19 which are assembled in the insulator in the electrical connector shell 18 to form a harness assembly. Thereafter, with the cover 14 removed from the endbell housing, the housing may be installed on the cable by pushing the cable through the slot 36 in the housing. Then the cover is oriented so that the tongues 48 and 52 thereon are aligned with the matching grooves 42 and 48 in the housing, and the cover is pushed forwardly until the shoulders 54 on the cover abut the bottoms 58 of the grooves 42. Then the endbell housing assembly may be threaded onto the rear of the shell 18 whereupon the cover will become locked to the housing 12. To remove the endbell from the harness assembly, the endbell is simply unthreaded from the connector shell, the cover 14 is slid off the endbell housing and the housing may then be removed by sliding the cable out through the slot 36. Thus, by this arrangement an endbell housing may be installed on or removed from a harness assembly at any time thus avoiding problems which may otherwise occur if the installer inadvertently fails to place an endbell on the cable prior to terminating the cable to the contacts in the electrical connector.

It is noted that notches 64 are formed in the endbell housing 12 on opposite sides of the slot 36 in the transition region between the forward portion 22 and rear portion 24 of the housing. Similar openings are formed in the opposite side of the housing. These openings serve as drain holes for allowing fluid which might become entrapped between the endbell and the connector shell to flow out of the assembly. If desired, holes 66 may be formed in the rear portion 24 of the housing on opposite sides of the bore 26 so that a clamping device may be assembled to the housing which may be tightened down around the cable 21 to firmly secure the cable to the endbell.

What is claimed is:

1. An endbell especially adapted for threading onto a connector shell which may contain contacts connected to the conductors of a cable comprising:

an endbell housing comprising a tubular wall defining a bore adapted to receive said cable;

a longitudinally extending slot in said wall of said housing dimensioned to allow said cable to be pushed laterally through said slot into said bore;

removable cover means for closing said slot after the cable is located in said bore;

tongue and groove means on said housing and said cover means for interlocking said housing and cover means; and one end of said housing and said cover means being threaded for threaded engagement as a unit with said connector shell.

2. An endbell as set forth in claim 1 wherein:

said tongue and groove means extend longitudinally allowing said cover means to be longitudinally slidably assembled to said housing.

3. An endbell as set forth in claim 2 including:

stop means on said cover means and said housing for limiting sliding engagement of said cover means with said housing to a position where the threads on said cover means and housing are precisely aligned.

4. An endbell as set forth in claim 2 wherein:

said housing and cover means are internally threaded at said one end.

5. An endbell especially adapted for threading onto a connector shell which may contain contacts connected to the conductors of a cable comprising:

a hollow endbell housing having a front and a rear;

said housing comprising a generally tubular wall defining a relatively large diameter bore opening at said front and a smaller diameter bore opening to said rear and communicating with said large diameter bore;

said large diameter bore being dimensioned to receive said shell therein and said smaller diameter bore being dimensioned to receive said cable therein with a relatively close fit;

a longitudinal slot in said wall of said housing extending radially beyond the circumference of said bores and extending the entire length of said housing and dimensioned to allow said cable to be pushed laterally through said slot into the interior of said housing;

removable cover means for closing said slot after the cable is located within said housing, said cover means having a forward end with an inner surface; and matching screw thread grooves and ridges formed in the wall of said large diameter bore and said inner surface of said forward end of said cover means providing a continuous screw thread for threading the endbell on said connector shell.

6. An endbell as set forth in claim 5 including:

longitudinally extending tongue and groove means on said housing and said cover means allowing said cover means to be longitudinally slidably assembled to said housing by pushing said cover means forwardly relative to said housing.

7. An endbell as set forth in claim 6 including:

stop means on said cover means and said housing for limiting sliding engagement of said cover means with said housing to a position where the thread grooves and ridges on said cover means and housing are continuous.

8. An endbell especially adapted for connection to a circular connector shell which may contain contacts connected to the conductors of a cable comprising:

a rotatable endbell housing comprising a tubular wall defining a bore adapted to receive said cable;

a longitudinally extending slot in said wall of said housing dimensioned to allow said cable to be pushed laterally through said slot into said bore;

removable cover means for closing said slot after the cable is located in said bore, said cover means being longitudinally slidably assembled to said housing; and said housing and said cover means having coupling means thereon for securing said housing and said cover means as a unit to said connector shell.

9. An endbell as set forth in claim 8 wherein:

said cover means and said housing embody interlocking tongue and groove means.

10. An electrical connector comprising:

a connector shell having a forward mating end and a rear portion, said shell being adapted to contain contacts which may be connected to the conductors of a cable;

said rear portion of said shell being threaded;

fastener means mounted on said rear portion of said shell;

said fastener means comprising a housing having a bore therethrough adapted to receive said cable;

a longitudinally extending slot in the wall of said housing dimensioned to allow said cable to be pushed laterally through said slot into said bore;

removable cover means for closing said slot after the cable is located in said bore;

said housing and said cover means embodying matching coupling means for allowing coupling engagement of said housing and said cover means as a unit on said shell and longitudinally extending tongue and groove means on said housing and said cover means allowing said cover means to be longitudinally slidably assembled to said housing before said housing and cover means are coupled as a unit on said shell.

11. An endbell especially adapted for connection to a circular connector shell which may contain contacts connected to the conductors of a cable, said connector shell having an externally threaded rear portion, comprising:

a rotatable endbell housing comprising a tubular wall defining a bore adapted to receive said cable;

a longitudinal slot in said wall of said housing extending radially beyond the circumference of said bores and extending the entire length of said housing and dimensioned to allow said cable to be pushed laterally through said slot into said bore;

removable cover means for closing said slot after the cable is located in said bore; and said housing and said cover means being internally threaded for securing said housing and said cover means as a unit to the externally threaded rear portion of said connector shell.

12. An endbell as set forth in claim 11 including:

interlocking means between said cover means and said housing for preventing said cover means from being leterally removed from said slot.

13. An electrical connector comprising:

a connector shell having a forward mating end and a rear portion, said shell having an insulator therein formed with longitudinally extending passages adapted to contain contacts which may be connected to the conductors of a cable;

said rear portion of said shell being externally threaded;

fastener means mounted on said rear portion of said shell;

said fastener means comprising a housing formed by a tubular wall having a bore therethrough adapted to receive said cable;

a longitudinal slot in said wall extending radially beyond the circumference of said bores and extending the entire length of said housing and dimensioned to allow said cable to be pushed laterally through said slot into said bore;

removable cover means for closing said slot after the cable is located in said bore; and said housing and said cover means being internally threaded for securing said housing and said cover means as a unit on said externally threaded shell.

* * * * *